US006043404A

United States Patent [19]

Hommeltoft et al.

[11] Patent Number: 6,043,404

[45] Date of Patent: Mar. 28, 2000

[54] REMOVAL OF ALKYL HALIDES FROM HYDROCARBON STREAM

[75] Inventors: Sven Ivar Hommeltoft, Hillerød; Karsten Laurents, Lyngby; Annemarie Bauer, Birkerød, all of Denmark

[73] Assignee: Haldor Topsoe A/S, Lyngby, Denmark

[21] Appl. No.: 09/217,779

[22] Filed: Dec. 21, 1998

[30] Foreign Application Priority Data

Dec. 19, 1997 [DK] Denmark ..... 1494/97

[51] Int. Cl.[7] ..... C07C 2/56; C07C 2/58; C10C 17/00

[52] U.S. Cl. ..... 585/713; 585/712; 585/723; 208/262.1

[58] Field of Search ..... 585/712, 713, 585/723; 208/262.1

[56] References Cited

U.S. PATENT DOCUMENTS

| | | | |
|---|---|---|---|
| 2,463,077 | 3/1949 | Zimmerman et al. | 206/683.4 |
| 2,636,912 | 4/1953 | Leatherman | 260/683.15 |
| 3,211,802 | 10/1965 | Dixon et al. | 260/683.045 |
| 3,769,177 | 10/1973 | Eubanks et al. | 203/71 |
| 3,784,628 | 1/1974 | Chapman | 260/683 |
| 4,009,222 | 2/1977 | Mikulicz et al. | 260/683 |
| 5,300,685 | 4/1994 | Scates et al. | 562/608 |
| 5,565,617 | 10/1996 | Schmidt et al. | 585/802 |

*Primary Examiner*—Hien Tran
*Assistant Examiner*—Tam M. Nguyen
*Attorney, Agent, or Firm*—Ostrolenk, Faber, Gerb & Soffen, LLP

[57] ABSTRACT

A process for the removal of alkyl halides from a liquid hydrocarbon substrate by reaction of the halides with an isoalkane and/or aromatic hydrocarbons in the presence of an acid catalyst supported on a solid support material.

6 Claims, No Drawings

REMOVAL OF ALKYL HALIDES FROM HYDROCARBON STREAM

The present invention is directed to a process for the removal of alkyl halides from a liquid hydrocarbon stream containing at least one isoalkane by contacting said hydrocarbon stream with a supported liquid phase acid catalyst in a fixed bed reactor under mild conditions.

Several processes in petroleum refining involve catalysts containing halides, which are converted to alkyl halides during reaction with hydrocarbons in the process feed. Alkyl halides, which are soluble in the hydrocarbon stream, are not desired in the product from the processes. As an example, isoalkyl fluorides are formed in HF catalysed processes such as isobutane alkylation or isoalkyl chlorides in the product from processes such as light alkane isomerisation or naphtha reforming using chloride promoted catalysts.

Prior art processes for the removal of alkyl fluorides from hydrocarbon substrate in general make use of absorption in an isoparaffin stream (U.S. Pat. No. 4,009,222) or on polymeric resins (U.S. Pat. No. 5,300,685). Furthermore, it is known to recover alkyl fluoride from isoparaffin by extraction with HF (U.S. Pat. No. 3,784,628) or distillation (U.S. Pat. No. 3,769,177).

It has now been found that alkyl halides may be effectively removed from a liquid hydrocarbon stream at low temperatures by reaction with isoalkane and/or aromatic hydrocarbons in presence of an acid catalyst.

Accordingly, this invention provides a process for the removal of alkyl halides from a liquid hydrocarbon substrate by reaction of the halide with an isoalkane and/or aromatic hydrocarbons in the presence of an acid catalyst supported on a solid support material.

Alkyl halides treated in the process according to the invention react with isoalkanes or aromatic hydrocarbons to form an alkylated substrate and a hydrogen halide.

Particularly useful hydrocarbons are those usually employed in the alkylation of hydrocarbons including isobutane and higher isoalkanes or aromatic hydrocarbons.

Preferred acid catalysts are those with a high acidity and include the perfluorinated sulphonic acids, such as trifluoromethanesulphonic acid and perfluoro-alkanesulphonic acids. The support material is conveniently chosen from the group of acid resistant refractory material, and is preferably silica gel. The support material may thereby be provided in any convenient shape such as particles, tablets, pellets, and the like, or be in the monolithic form.

In further a preferred embodiment of the invention, the process is carried out in the presence of trifluoromethanesulphonic acid supported on a fixed bed of silica gel particles. The invention will become more apparent by the following examples.

EXAMPLES

Example 1

Removal of sec-butyl chloride by reaction with isobutane.

The reaction was carried out in a 100 ml reactor loaded with silica gel (Merck 100, 0.2–0.5 mm particle size). The reactor was maintained at a temperature of 0° C. and 40° C. in a thermostated bath. 6 ml trifluoromethanesulphonic acid were injected into the reactor and a feed stream of 0.1 wt % of sec-butyl chloride and 5 wt % 2-butene in isobutane were then passed through the reactor at a flow-rate of 2.5–3 g/min. The pressure was kept at about 15 bar to ensure that the feed stream is in the liquid phase. Conversion of sec-butyl chloride was measured by GC analysis of the effluent stream. At a temperature of 0° C., 65% of sec-butyl chloride content in the feed have been removed and more than 98% at 40° C.

Example 2

Removal of isopropyl fluoride.

A reactor as described in Example 1 was maintained at 30° C. 6 ml trifluoromethanesulphonic acid were added to the reactor and feed stream containing 0.2 wt % isopropyl fluoride and 5 wt % 2-butene in isobutane were then passed through the reactor at a flow rate of 8 g/min. and a pressure of about 15 bar. The conversion of isopropyl fluoride was determined by GC analysis of the effluent stream from the reactor. Isopropyl fluoride was substantially quantitative (>99%) removed by reaction in the feed stream.

Example 3

Removal of isopropyl fluoride in an olefin-free feed stream.

Removal of isopropyl fluoride was carried out in a similar process as described above in Example 2 with the exception that a feed stream with 5 wt % isopropyl fluoride in isobutane were used. After a certain time on stream analysis of the effluent revealed that removal of isopropyl fluoride and formation of a hydrocarbon product with a composition similar to the composition of alkylated products formed by alkylation of isobutane with propene.

We claim:

1. A process for the removal of alkyl halides from a liquid hydrocarbon substrate, comprising reacting the alkyl halide with an isoalkane and/or aromatic hydrocarbons in the presence of an acid catalyst supported on a solid support material and at a temperature in a range of from 0° C. to 40° C.

2. Process of claim 1, wherein the catalyst is a liquid super acid.

3. Process of claim 1, wherein the catalyst is a perfluorinated sulphonic acid.

4. Process of claim 1, wherein the catalyst is trifluoromethanesulphonic acid.

5. Process of claim 1, wherein the solid support material is silica gel.

6. Process of claim 1, wherein the hydrocarbon substrate consists of isobutane.

* * * * *